US007867033B2

(12) United States Patent
Kumagai et al.

(10) Patent No.: US 7,867,033 B2
(45) Date of Patent: Jan. 11, 2011

(54) BRANCH CONNECTOR

(75) Inventors: Tooru Kumagai, Yokkaichi (JP); Toshiyasu Tsubouchi, Yokkaichi (JP)

(73) Assignees: Autonetworks Technologies, Ltd, Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 12/312,611

(22) PCT Filed: Nov. 12, 2007

(86) PCT No.: PCT/JP2007/071909

§ 371 (c)(1),
(2), (4) Date: May 19, 2009

(87) PCT Pub. No.: WO2008/072442

PCT Pub. Date: Jun. 19, 2008

(65) Prior Publication Data

US 2010/0062643 A1 Mar. 11, 2010

(30) Foreign Application Priority Data

Dec. 11, 2006 (JP) ..... 2006-333129

(51) Int. Cl.
*H01R 13/66* (2006.01)

(52) U.S. Cl. ..... 439/620.01; 439/681

(58) Field of Classification Search ..... 439/620.01, 439/620.05, 620.07, 680–681
See application file for complete search history.

(56) References Cited

U.S. PATENT DOCUMENTS 5,221,215 A * 6/1993 Tan et al. ..... 439/620.1
5,314,356 A * 5/1994 Isohata et al. ..... 439/681
6,045,406 A * 4/2000 Cortes ..... 439/620.05
6,375,510 B2 * 4/2002 Asao ..... 439/620.05
7,097,509 B2 * 8/2006 Newton et al. ..... 439/620.01

(Continued)

FOREIGN PATENT DOCUMENTS

JP A-1-315212 12/1989

(Continued)

OTHER PUBLICATIONS

Japanese Patent Office, *Japanese Office Action for Japanese Patent Application No. 2006-333129* (with English translation), Aug. 24, 2010, pp. 1-2.

*Primary Examiner*—Truc T Nguyen
(74) *Attorney, Agent, or Firm*—Oliff & Berridge PLC

(57) ABSTRACT

A branch connector located at a position where a branch line is connectedly branched from a main line constituting a communication circuit, comprising: inside a connector housing thereof, one or a plurality of bus bars each having a joint part long and narrow and a plurality of electric wire connection terminal parts projected by spacing said electric wire connection terminal parts at a certain interval from said joint part in a longitudinal direction thereof; a plurality of cylindrical insulation parts each having a hollow portion through which one of said electric wire connection terminal parts is inserted; and a plurality of filter materials each of which is made of a conductive magnetic material and fitted on one of said cylindrical insulation parts to prevent each of said filter materials and said corresponding electric wire connection terminal part from contacting each other.

3 Claims, 6 Drawing Sheets

U.S. PATENT DOCUMENTS

| | | | | |
|---|---|---|---|---|
| 7,097,514 | B2 * | 8/2006 | Ishizaki et al. | 439/681 |
| 7,524,206 | B2 * | 4/2009 | Gutierrez et al. | 439/607.01 |
| 7,540,775 | B2 * | 6/2009 | Eckel et al. | 439/587 |
| 7,547,232 | B2 * | 6/2009 | Johannes et al. | 439/620.07 |

FOREIGN PATENT DOCUMENTS

| | | |
|---|---|---|
| JP | A-6-76886 | 3/1994 |
| JP | A-2002-352916 | 12/2002 |

* cited by examiner

[Prior Art]

BRANCH CONNECTOR

TECHNICAL FIELD

The present invention relates to a branch connector and more particularly to a branch connector having a function of softening a transmission waveform distortion which occurs at a branch connection part where a branch line is branched from a main line of a communication network such as a LAN mounted on a vehicle.

BACKGROUND ART

In the communication network such as a network mounted on a vehicle, in transmitting signals from one communication apparatus to other communication apparatus, there occurs a problem that owing to an electric noise or a magnetic noise, the transmission waveform distorts and that communication is not normally performed. The waveform distortion is generated owing to mainly the reflection of signals caused by impedance unmatching. The impedance unmatching is unavoidably generated at a branch point of a communication line and a connection point between the communication line and a substrate accommodated inside a communication apparatus. Therefore various arts for improving the waveform distortion at the branch point and the connection point between the communication line and the communication apparatus.

For example, in the art disclosed in Japanese Patent Application Laid-Open No. 6-76886 (patent document 1), as shown in FIG. 7, the terminal 2 accommodated inside the connector housing 1 is inserted through the cylindrical ferrite core 3 to improve the transmission waveform distortion.

Because the ferrite core 3 has an insulation property, electric current does not flow through the ferrite core 3 when the ferrite core 3 contacts the terminal 2. Thus the transmission waveform distortion can be improved.

But when a silicon steel plate or a permalloy which is a conductive magnetic material is used instead of the ferrite core 3, electric current flows through the silicon steel plate or the permalloy when the silicon steel plate or the permalloy contacts a terminal. Therefore the transmission waveform distortion cannot be improved.

As described above, the construction proposed in the patent document 1 has a problem that although it is possible to use the magnetic material such as the ferrite core having an insulation property as the filter material, it is impossible to use the conductive magnetic material such as the silicon steel plate or the permalloy as the filter material.

Patent document 1: Japanese Patent Application Laid-Open No. 6-76886

DISCLOSURE OF THE INVENTION

Problem to be Solved by the Invention

The present invention has been made in view of the above-described problem. Thus it is an object of the present invention to provide a branch connector in which a filter material for improving a transmission waveform distortion is made of a conductive magnetic material.

Means for Solving the Problem

To solve the above-described problem, the present invention provides a branch connector located at a position where a branch line is connectedly branched from a main line constituting a communication circuit, including:

inside a connector housing thereof, one or a plurality of bus bars each having a joint part long and narrow and a plurality of electric wire connection terminal parts projected by spacing the electric wire connection terminal parts at a certain interval from the joint part in a longitudinal direction thereof;

a plurality of cylindrical insulation parts each having a hollow portion through which one of the electric wire connection terminal parts is inserted; and a plurality of filter materials each of which is made of a conductive magnetic material and fitted on one of the cylindrical insulation parts to prevent each of the filter materials and the corresponding electric wire connection terminal part from contacting each other.

In the branch connector of the present invention, because the electric wire connection terminal part of the bus bar forming the branch connection part is inserted through the filter material made of the magnetic material, the filter material absorbs a magnetic field generated in the vicinity of the branch connection part and transforms the magnetic field into heat. Thereby the filter material is capable of decreasing a high-frequency component which has increased owing to impedance unmatching of the branch connection part and ideally improving the transmission waveform distortion liable to be generated at the branch connection part.

The filter material is not directly fitted on the electric wire connection terminal part, but the cylindrical insulation part is interposed between the electric wire connection terminal part and the filter material to prevent the electric wire connection terminal part and the filter material from contacting each other. Therefore the filter material can be made of not only ferrite having an insulation property, but also a conductive magnetic material.

As the filter material made of the conductive magnetic material, a silicon steel plate and a permalloy is listed.

The silicon steel plate and the permalloy have a higher strength than ferrite and chips or breaks to a lower extent than the ferrite. Further the silicon steel plate and the permalloy have a merit that they are less expensive than the ferrite.

It is preferable that each of the cylindrical insulation parts is projected integrally from a peripheral edge of each of terminal holes, formed through a bottom wall of a connector fit-in part of the connector housing in which mating connectors are fitted, through which the electric wire connection terminal parts are penetrated respectively.

In the above-described construction, because it is unnecessary to provide the branch connector with a member separate from the connector housing in order to provide the cylindrical insulation part for insulating the filter material and the electric wire connection terminal part from each other, it is possible to prevent an increase in the number of parts of the branch connector.

It is possible that each of the cylindrical insulation parts is provided as a portion of an insulation member separate from the connector housing and that the insulation member is constructed of a plurality of the cylindrical insulation parts connected to each other with a connection part thereof.

In the above-described construction, because it is unnecessary to provide the connector housing with the cylindrical insulation part for insulating the filter material and the electric wire connection terminal part from each other, it is possible to use a branch connector having the conventional connector housing and the insulation member mounted thereon.

Effect of the Invention

As described above, in the present invention, because the cylindrical insulation part is interposed between the electric wire connection terminal part of the bus bar forming the branch connection part and the filter material for improving the transmission waveform distortion generated at the branch connection part to prevent the electric wire connection terminal part and the filter material from contacting each other. Therefore the filter material can be made of the conductive magnetic material.

BRIEF DESCRIPTION OF THE DRAWINGS

FIG. 6 shows a modification example of the second embodiment, in which

EXPLANATION OF REFERENCE NUMERALS AND SYMBOLS

Figure 1:
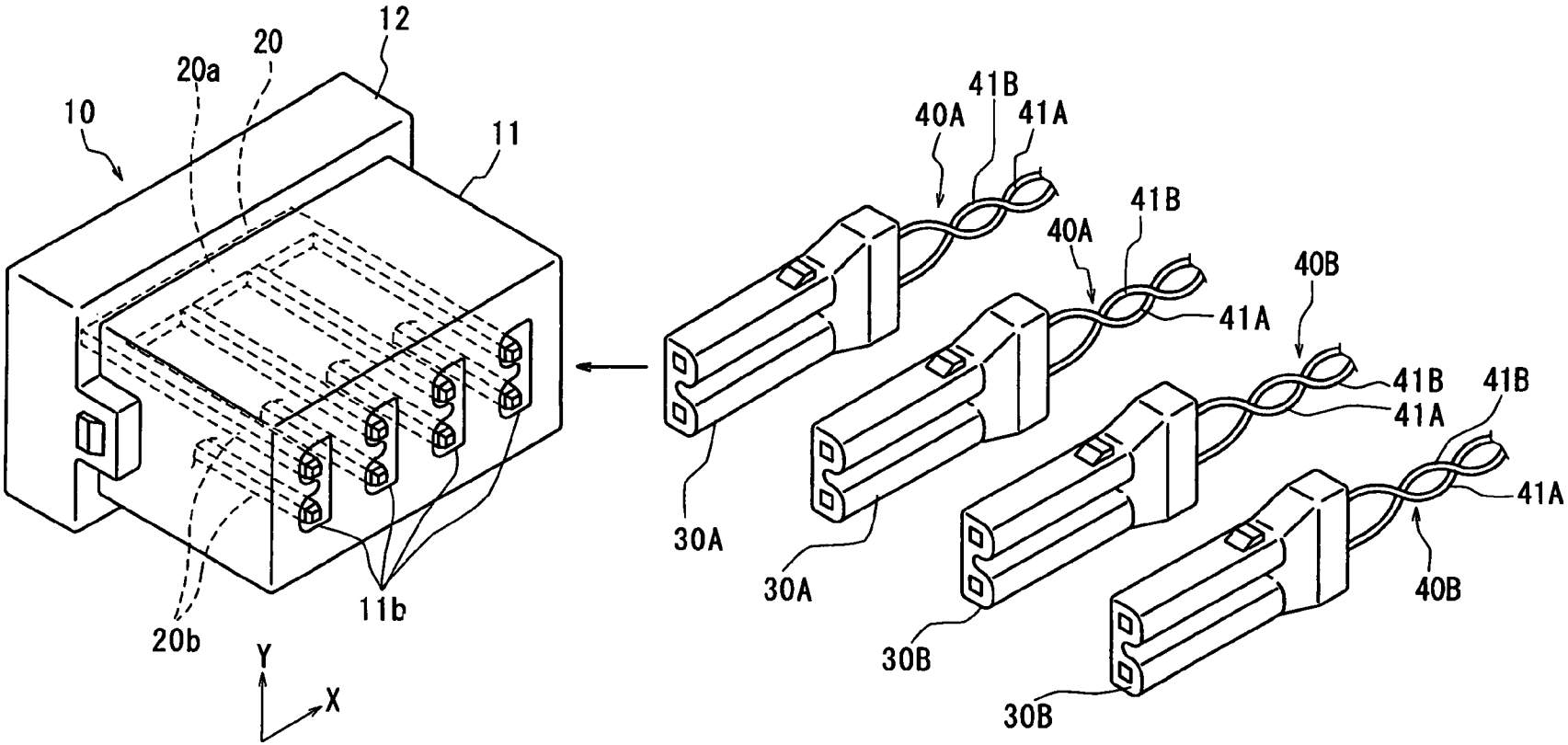
FIG. 1 shows a branch connector of a first embodiment of the present invention and connectors to be connected to the branch connector.

10: branch connector
11: connector housing
11*a*: bus bar accommodation part
11*b*: connector fit-in part
11*c*: bottom wall
11*d*: terminal hole
11*e*: cylindrical insulation part
11*f*: hollow portion
20: bus bar
20*a*: joint part
20*b*: electric wire connection terminal part
21: filter material

BEST MODE FOR CARRYING OUT THE INVENTION

The embodiments of the present invention are described below with reference to the drawings.

FIGS. 1 through 4 show a first embodiment of the present invention. A branch connector 10 forms a branch portion where a branch line branches from a main line in a LAN, mounted on a vehicle, for executing CAN communication (differential transmission method).

Figure 2:
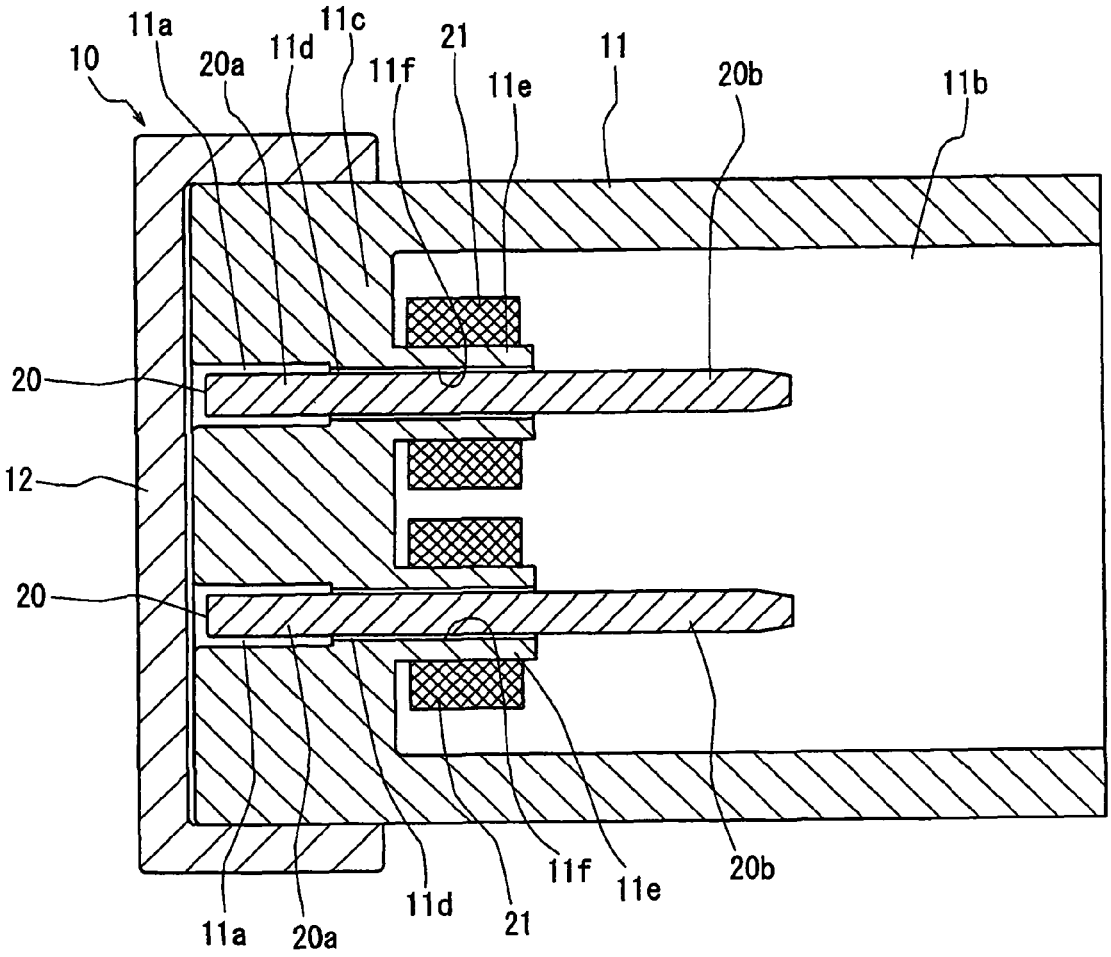
FIG. 2 is a sectional view of the branch connector.

As shown in FIG. 2, at one side of a connector housing 11 of the branch connector 10 made of resin molding, a bus bar accommodation part 11*a* extended in a left-to-right direction X is arranged in two steps in a vertical direction Y. At the other side of the connector housing 11, four connector fit-in parts 11*b* are arranged in the left-to-right direction X. The bus bar accommodation part 11*a* and the connector fit-in part 11*b* are partitioned from each other by a bottom wall 11*c*. Terminal holes 11*d* communicating with the bus bar accommodation part 11*a* and the connector fit-in part 11*b* are formed through the bottom wall 11*c* by spacing the terminal holes 11*d* at predetermined intervals in the left-to-right direction X. A cylindrical insulation part 11*e* is projected from a peripheral edge of each of the terminal holes 11*d* formed through the bottom wall 11*c* into the connector fit-in part 11*b* with the terminal hole 11*d* and the hollow portion 11*f* of the cylindrical insulation part 11*e* communicating with each other.

A bus bar 20 to be accommodated in the bus bar accommodation part 11*a* of the connector housing 11 is composed of a long and narrow joint part 20*a* and a plurality of electric wire connection terminal parts 20*b* projected by spacing them from the joint part 20*a* at a predetermined interval in the longitudinal direction of the joint part 20*a*.

The joint part 20*a* of the bus bar 20 is accommodated in the bus bar accommodation part 11*a* of the connector housing 11. The electric wire connection terminal part 20*b* is penetrated through the terminal hole 11*d* of the connector housing 11 and a hollow portion 11*f* of the cylindrical insulation part 11*e* with a front portion of the electric wire connection terminal part 20*b* projected into the connector fit-in part 11*b*. With the bus bar 20 accommodated inside the connector housing 11, a cover 12 is locked to the connector housing 11 at one side thereof where the bus bar accommodation part 11*a* is formed to close an open end of the bus bar accommodation part 11*a*.

Figure 3:
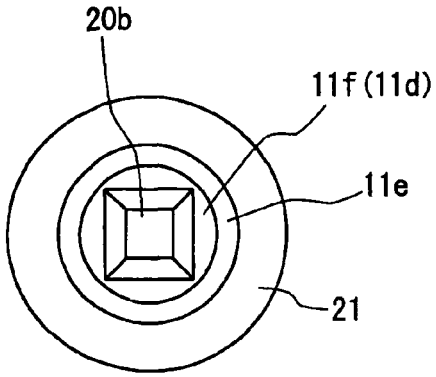
FIG. 3 shows a state in which an electric wire connection part of a bus bar is inserted through a cylindrical insulation part, which is viewed from a front side of the electric wire connection part.

As shown in FIGS. 2 and 3, a cylindrical filter material 21 is fitted on a peripheral surface of the cylindrical insulation part 11*e* projected into the connector fit-in part 11*b*. In the first embodiment, the filter material 21 is constructed of a silicon steel plate consisting of a conductive magnetic material.

Figure 4:
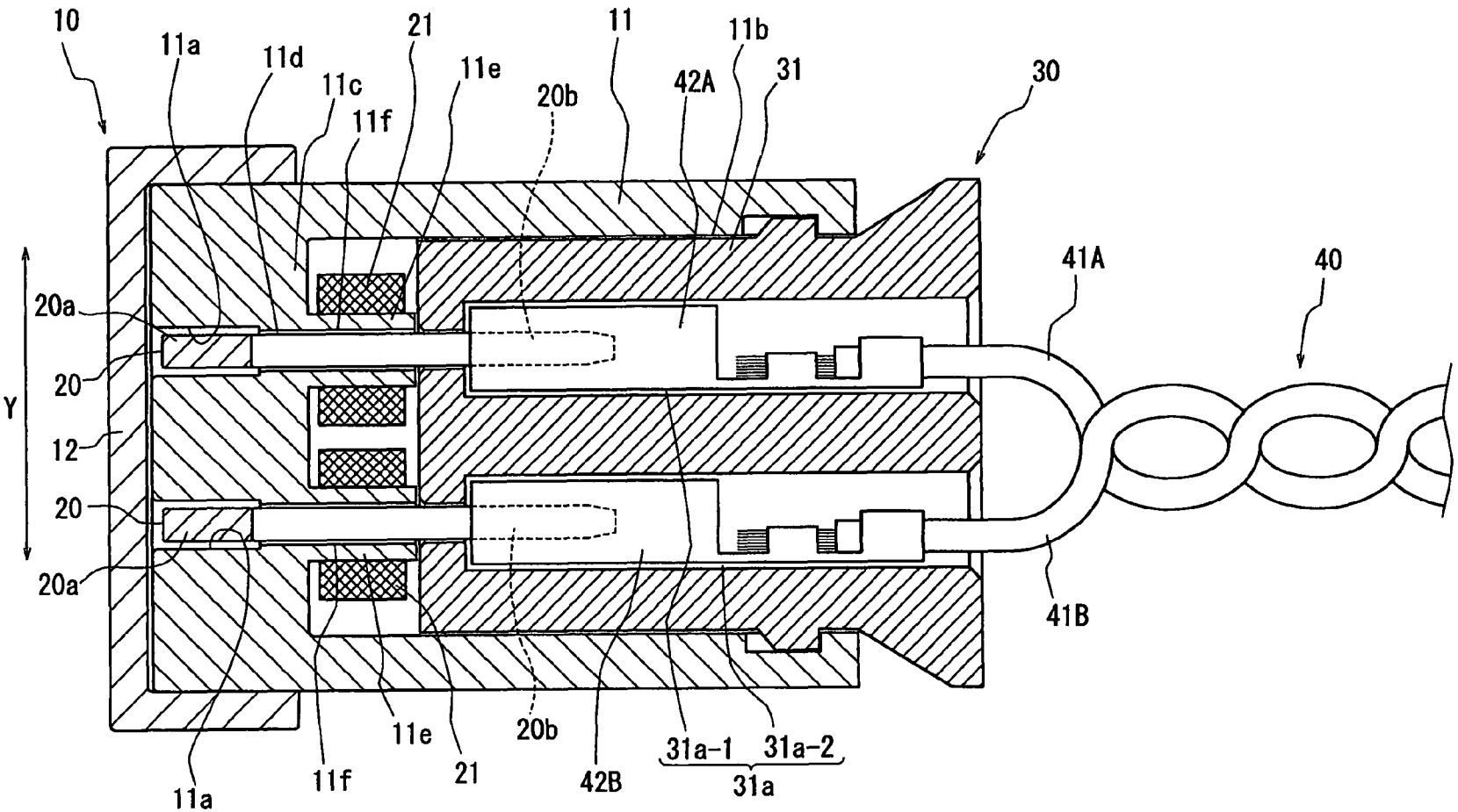
FIG. 4 is a sectional view showing a state in which the connectors are connected to the branch connector.

As shown in FIG. 4, two terminal accommodation chambers 31*a* are arranged in the vertical direction Y inside a connector housing 31 of each of connectors 30 to be fitted in the connector fit-in part 11*b* of the connector housing 11. The connector 30 is connected to a terminal of a twist pair electric wire 40 constructing a differential transmission line. A terminal 42A connected to a terminal of a first communication line 41A (CAN_H) of the twist pair electric wire 40 is inserted into an upper terminal accommodation chamber 31*a*-1. A terminal 42B connected to a terminal of a second communication line 41B (CAN_L) of the twist pair electric wire 40 is inserted into a lower terminal accommodation chamber 31*a*-2.

In the first embodiment, a connector 30A connected to terminals of two twist pair electric wires 40A constructing a main line of a communication circuit and a connector 30B connected to terminals of two twist pair electric wires 40B constructing a branch line of the communication circuit are fitted in the connector fit-in part 11*b* of the branch connector 10. At this time, the electric wire connection terminal parts 20*b* of the bus bars 20 accommodated inside the branch connector 10 are connectedly fitted in the terminals 42A and 42B of the connector 30 respectively in a female and male relationship. Thereby the first communication lines 41A of the twist pair electric wire 40 are connected to each other via the bus bars 20, and the second communication lines 41B thereof are connected to each other via the bus bars 20.

Of the electric wire connection terminal parts 20*b* of the bus bars 20, the filter material 21 does not necessarily have to be disposed on the periphery of the electric wire connection terminal part 20*b* of the bus bar 20 to be connected to the twist pair electric wire 40A constructing the main line.

In the above-described construction, because the electric wire connection terminal part 20*b* of the bus bar 20 forming the branch connection part is inserted through the filter material 21 made of the magnetic material, the filter material 21 absorbs a magnetic field generated in the vicinity of the branch connection part and transforms the magnetic field into heat. Thereby the filter material 21 is capable of decreasing a high-frequency component which has increased owing to impedance unmatching of the branch connection part and ideally improving the transmission waveform distortion liable to be generated at the branch connection part.

The filter material is not directly fitted on the electric wire connection terminal part 20*b*, but the cylindrical insulation part 11*e* is interposed between the electric wire connection terminal part 20*b* and the filter material 21 to prevent the electric wire connection terminal part 20*b* and the filter material 21 from contacting each other. Therefore the filter material 21 can be made of the silicon steel plate consisting of the conductive magnetic material. The filter material may be made of the permalloy.

In the first embodiment, because the twist pair electric wire 40 constructing the differential transmission line is connected to the branch connector 10, the bus bars 20 are disposed in two steps inside the connector housing 11. But in connecting electric wires other than the twist pair electric wire to the branch connector 10, the bus bar may be disposed in one step or not less than three steps inside the connector housing 11.

Figure 5:
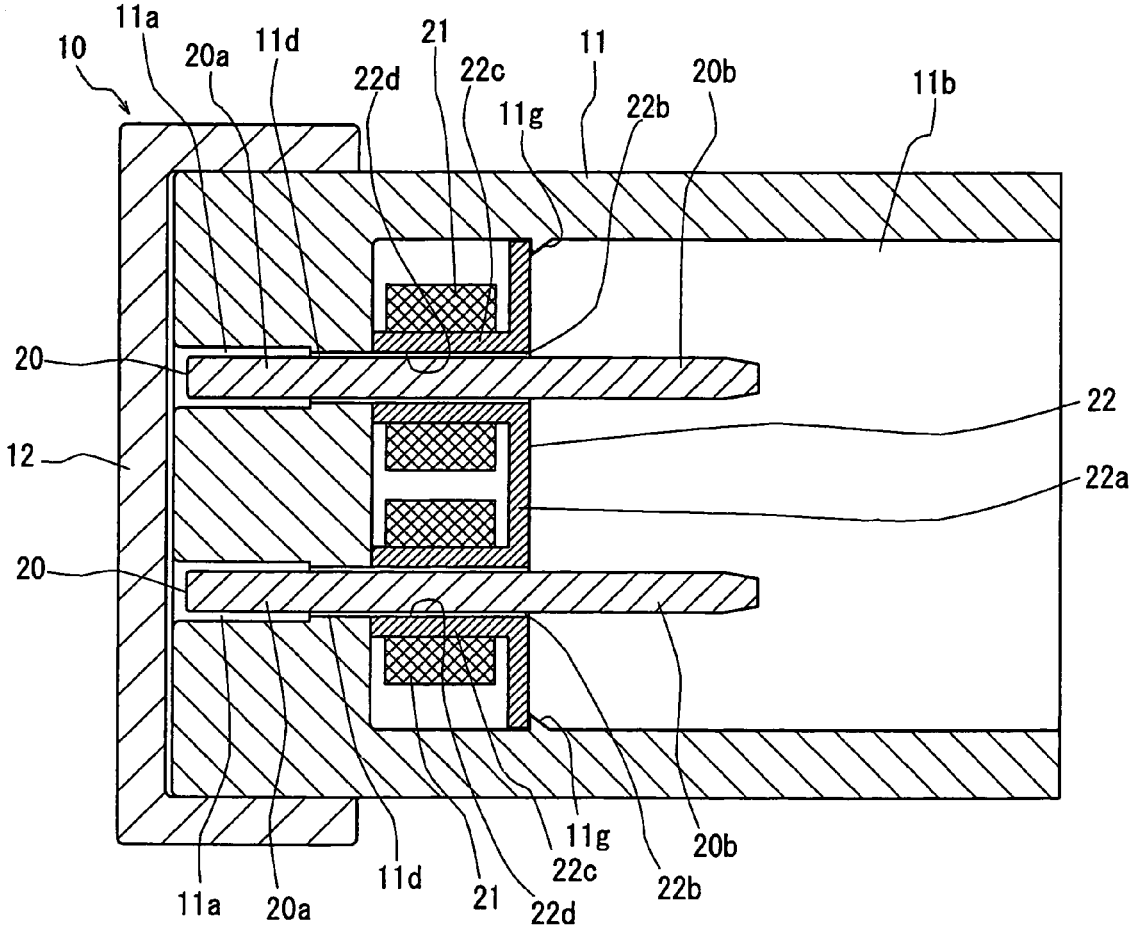
FIG. 5 shows a branch connector of a second embodiment.

FIG. 5 shows a second embodiment of the present invention.

In the second embodiment, a cylindrical insulation part through which the electric wire connection terminal part 20*b* of the bus bar 20 is penetrated is provided as a portion of an insulation member 22, consisting of a resin molding, which is separate from the connector housing 11.

In the insulation member 22, a plurality of through-holes 22*b* confronting the terminal holes 11*d* of the connector housing 11 respectively is formed through a plate-shaped connection part 22*a*, and a cylindrical insulation part 22*c* is projected from a peripheral edge of each through-hole 22*b*. With the filter material 21 similar to that of the first embodiment fitted on the cylindrical insulation part 22*c*, the insulation member 22 is inserted into the connector fit-in part 11*b* from a front side of the cylindrical insulation part 22*c*, the electric wire connection terminal part 20*b* of the bus bar 20 is penetrated through a hollow portion 22*d* of the cylindrical insulation part 22*c*, and a peripheral edge of the connection part 22*a* of the insulation member 22 is locked to a locking claw 11*g* provided on an inner surface of the connector fit-in part 11*b*. Thereby the insulation member 22 is fixedly placed in position inside the connector fit-in part 11*b*. At this time, the connection part 22*a* of the insulation member 22 constructs a bottom wall of the connector fit-in part 11*b*.

The insulation members 22 may be so constructed as to be accommodated in a plurality of connector fit-in parts 11*b* respectively. Partitioning walls may be formed on the insulation member 22 to divide one connector fit-in part 11*b* provided inside the connector housing 11 into a plurality of the connector fit-in parts 11*b* by the partitioning walls of the insulation member 22.

The second embodiment has the same construction, operation, and effect as those of the first embodiment. Thus the same parts of the second embodiment as those of the first embodiment are denoted by the same reference numerals as those of the first embodiment, and the description thereof is omitted herein.

Figure 6A:
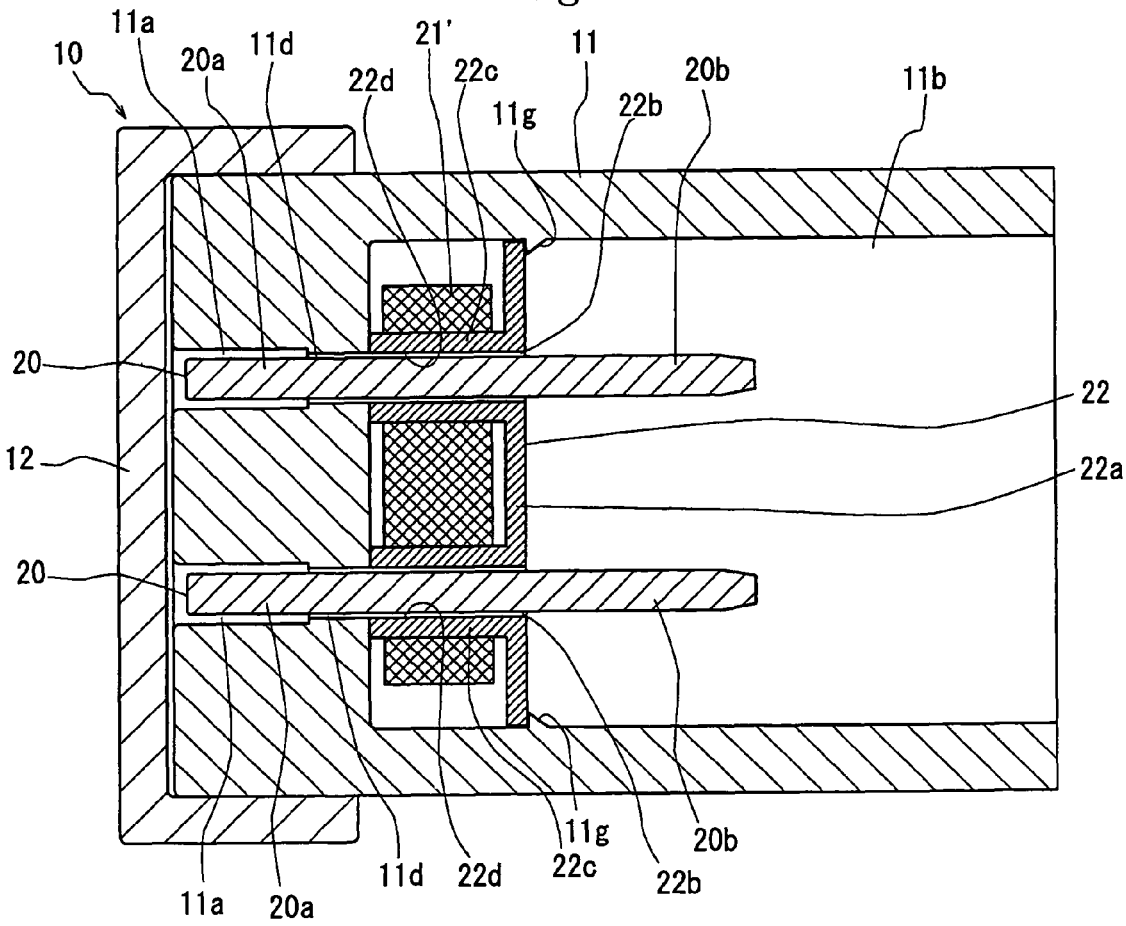
FIG. 6(A) is a sectional view of the branch connector.

FIG. 6 shows a modification example of the second embodiment.

Figure 6B:
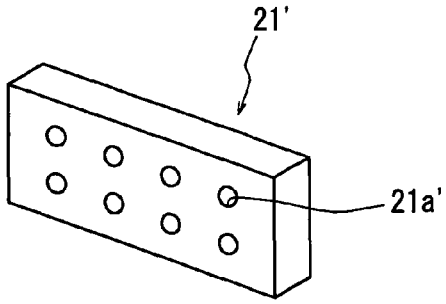
FIG. 6(B) is a perspective view of a filter material.
Figure 7:
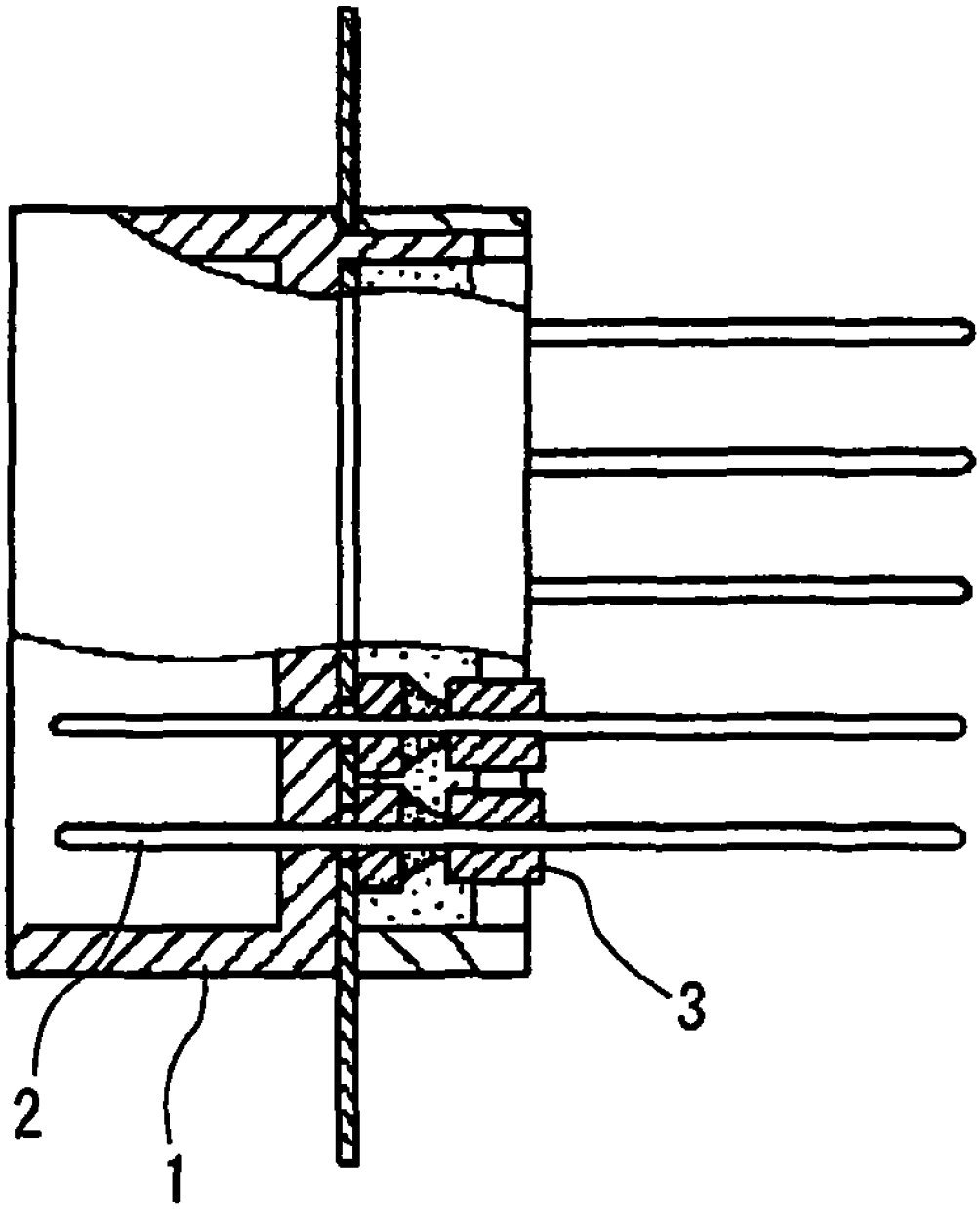
FIG. 7 shows a conventional art.

In the modification example, the filter material to be fitted on the cylindrical insulation part 22*c* is formed not separately, but a filter material 21' to be accommodated inside the connector housing 11 is formed as one piece. That is, as shown in FIG. 6(B), the plate-shaped filter material 21' to be fitted on the cylindrical insulation part 22*c* has a plurality of through-holes 21*a'* formed therethrough.

The above-described construction provides an effect similar to that of the second embodiment and is capable of decreasing the number of parts of the branch connector because the filter material 21' is formed as one piece.

The modification example of the second embodiment has the same construction, operation, and effect as those of the first embodiment. Thus the same parts of the modification example as those of the first embodiment are denoted by the same reference numerals as those of the first embodiment, and the description thereof is omitted herein.

INDUSTRIAL APPLICABILITY

The branch connection construction of a communication line of the present invention is preferably used for a communication circuit of a LAN, an OA (Office Automation), an FA (Factory Automation) and the like.

What is claimed is:

1. A branch connector located at a position where a branch line is connectedly branched from a main line constituting a communication circuit, comprising:

inside a connector housing thereof, one or a plurality of bus bars each having a joint part long and narrow and a plurality of electric wire connection terminal parts projected by spacing said electric wire connection terminal parts at a certain interval from said joint part in a longitudinal direction thereof;

a plurality of cylindrical insulation parts each having a hollow portion through which one of said electric wire connection terminal parts is inserted;

a plurality of filter materials each of which is made of a conductive magnetic material and fitted on one of said cylindrical insulation parts to prevent each of said filter materials and said corresponding electric wire connection terminal part from contacting each other; and a connector fit-in part accommodating connectors connected to terminals of twist pair electric wires constructing the main line of the communication circuit and connectors connected to terminals of twist pair electric wires constructing branch lines of the communication circuit is provided, and the main line and the branch lines are branch connected via the bus bars accommodated in the connector housing of the branch connector.

2. The branch connector according to claim 1, wherein each of said cylindrical insulation parts is projected integrally from a peripheral edge of each of terminal holes, formed through a bottom wall of a connector fit-in part of said connector housing in which mating connectors are fitted, through which said electric wire connection terminal parts are penetrated respectively or;

each of said cylindrical insulation parts is provided as a portion of an insulation member separate from said connector housing; and said insulation member is constructed of a plurality of said cylindrical insulation parts connected to each other with a connection part thereof.

3. The branch connector according to claim 1, wherein said filter material is made of a silicon steel or permalloy.

* * * * *